US005854962A

United States Patent [19]

Boockholdt et al.

[11] Patent Number: 5,854,962

[45] Date of Patent: Dec. 29, 1998

[54] ELECTROPHOTOGRAPHIC COMPONENT CLEANING APPARATUS

[75] Inventors: Darius Boockholdt, Eagle; Howard G. Hooper, Boise; Quintin T. Phillips, Boise, all of Id.

[73] Assignee: Hewlett-Packard Company, Palo Alto, Calif.

[21] Appl. No.: 936,096

[22] Filed: Sep. 23, 1997

[51] Int. Cl.[6] ..... G03G 21/00

[52] U.S. Cl. ..... 399/343

[58] Field of Search ..... 399/98, 99, 110, 399/111, 123, 343, 345, 347, 349, 352, 353, 357, 358

[56] References Cited

U.S. PATENT DOCUMENTS

| | | | |
|---|---|---|---|
| 3,947,108 | 3/1976 | Thettu et al. . | |
| 5,148,227 | 9/1992 | Senba et al. | 399/349 |
| 5,179,416 | 1/1993 | Ku et al. . | |
| 5,323,213 | 6/1994 | Ahn | 399/357 X |
| 5,560,980 | 10/1996 | Sakaki et al | 399/343 X |
| 5,705,447 | 1/1998 | Kubo | 399/357 X |
| 5,740,498 | 4/1998 | Tsuchiya | 399/98 |

*Primary Examiner*—Sandra Brase
*Attorney, Agent, or Firm*—Gregg W. Wisdom

[57] ABSTRACT

The first embodiment of an electrophotographic component cleaning apparatus includes a sheet of cleaning media, formed from a material such as felt, cloth or abrasive impregnated plastic fibers. Attached to the cleaning media is a retaining device. Preferably, the retaining device includes a plastic tab bonded to the sheet of cleaning media. Attached to the plastic tab is a plastic strap with an adhesive located on the free end. For use, the cleaning media is inserted into the print media path of the printer with the plastic strap looped around any conveniently protruding feature inside the printer. The rotation of the drum against the cleaning media results in the removal of contaminants. A second embodiment of an electrophotographic component cleaning apparatus includes an oversized cleaning roller which is installed into the printer in place of the transfer roller. A reservoir pivotally attached to the shaft of the cleaning roller contains cleaning fluid which is absorbed into the cleaning roller. Movement of the cleaning roller over the surface of the photoconductor drum results in the removal of contaminants. In a third embodiment of the electrophotographic component cleaning apparatus for use with an electrophotographic print cartridge, the electrophotographic print cartridge is mounted into a stand with the drum in contact with the cleaning roller. Movement of the cleaning roller over the surface of the photoconductor drum results in the removal of contaminants. A fourth embodiment of the electrophotographic component cleaning apparatus uses a cleaning pad disposed in the channel of a cleaning pad holder. The cleaning pad holder is inserted into the laser beam access slot in the electrophotographic print cartridge so that the pad contacts the photoconductor drum through the slot. Movement of the cleaning pad over the surface of the photoconductor drum resulting from rotation provides the cleaning action.

17 Claims, 9 Drawing Sheets

ELECTROPHOTOGRAPHIC COMPONENT CLEANING APPARATUS

FIELD OF THE INVENTION

The present invention relates generally to electrophotographic image formation and, more particularly, to the cleaning of electrophotographic components used in electrophotographic image formation.

BACKGROUND OF THE INVENTION

Photoconductors are used in electrophotographic imaging devices for the formation and subsequent development of the latent electrostatic image. Photoconductors include photoconductor drums and photoconductor belts. As a result of the electrophotographic imaging process, contaminants, including such things as paper fibers, toner constituents, paper filler materials (magnesium silicate, calcium carbonate, titanium dioxide, etc.), and plastic materials from transparencies or coated print media can accumulate on the surface of the photoconductor. In addition, the surfaces of other components in the electrostatic image forming process, such as transfer belts and transfer drums, can also become contaminated from the electrophotographic image forming process. Because the print media characteristics vary widely between different media types, there is great uncertainty in the type and level of contaminants to which the photoconductor will be exposed.

These contaminants can cause print quality defects and can result in the degradation of print quality. Typically, those components used in the electrostatic image forming process which are in direct contact with print media are the most susceptible to contamination. However, it is possible that contaminants transferred to components that are not directly in contact with print media can result in print quality defects. When contaminant levels on the surface of the photoconductor are sufficiently high, the contaminants interfere with the formation of electrostatic images resulting in print defects. For example, a contaminant film on the surface of the photoconductor may prevent proper charging of the photoconductor or discharging of the photoconductor for the formation of the latent electrostatic image. As another example, paper fibers may accumulate over time between the photoconductor and a cleaning blade so that residual toner on the surface of the photoconductor is not effectively removed. Contaminants can also result in damage to electrophotographic components. For example, contact with contaminants over time can result in increased wear of the photoconductor, which in turn results in the degradation of print quality.

Prior art attempts to clean electrophotographic components have generally been implemented within the image forming device, such as an electrophotographic printer or an electrophotographic copier. In addition, in the prior art, cleaning devices have been implemented within electrophotographic cartridges used in printers. However, the mechanical structure required to implement the cleaning in the image forming device or the cartridge adds considerably to the cost of the solution. Furthermore, with "in-process" cleaning devices, the cleaning process is occurring as the electrophotographic process is performed. Because the cleaning process occurs continuously as the electrophotographic process is performed, more wear than necessary occurs on the electrophotographic components. A need exists for an electrophotographic component cleaning device that is less expensive to implement and results in less wear of the electrophotographic components than the current solutions.

SUMMARY OF THE INVENTION

To fill this need, a low cost, reduced wear apparatus for cleaning an electrophotographic component has been developed. The first implementation of the apparatus for cleaning an electrophotographic component includes a sheet of cleaning media with an attached retaining device. The retaining device holds the cleaning media in the media path during movement of the electrophotographic component. To remove contaminants from the electrophotographic component, the cleaning media is inserted into the media path of an electrophotographic imaging device containing the electrophotographic component. The retaining device is attached to the electrophotographic imaging device containing the electrophotographic component. Relative motion between the electrophotographic component and the cleaning media while they are in contact results in removal of contaminants from the electrophotographic component.

The second implementation of the apparatus for cleaning an electrophotographic component includes a cleaning roller formed from a resilient material. The cleaning roller is compressed against the electrophotographic component. Relative motion between the electrophotographic component and the cleaning roller results in removal of contaminants from the electrophotographic component.

A third implementation of the apparatus for cleaning an electrophotographic component includes a member having a channel in which a pad is located. The pad is formed of a resilient material. When component cleaning is desired the member is mounted onto the electrophotographic imaging device, the pad is in contact with the electrophotographic component. Relative motion between the electrophotographic component and the pad results in removal of contaminants from the electrophotographic component.

DESCRIPTION OF THE DRAWINGS

A more thorough understanding of the invention may be had from the consideration of the following detailed description taken in conjunction with the accompanying drawings in which.

DETAILED DESCRIPTION OF THE PREFERRED EMBODIMENTS

The present invention is not limited to the specific exemplary embodiments illustrated herein. Although the embodiments of the electrophotographic component cleaning apparatus will be discussed in the context of a monochrome electrophotographic printer using a replaceable electrophotographic cartridge, one of ordinary skill in the art will recognize by understanding this specification that the electrophotographic component cleaning apparatus has applicability for both color and monochrome electrophotographic image forming systems including copiers and printers. Furthermore, although the embodiments of the electrophotographic component cleaning apparatus will be discussed in the context of a monochrome electrophotographic printer using a photoconductor drum, one of ordinary skill in the art will recognize by understanding this specification that the embodiments of electrophotographic component cleaning apparatus could be used with other types of electrophotographic components, such as a photoconductor belt, transfer belt, or a transfer drum.

Figure 1:
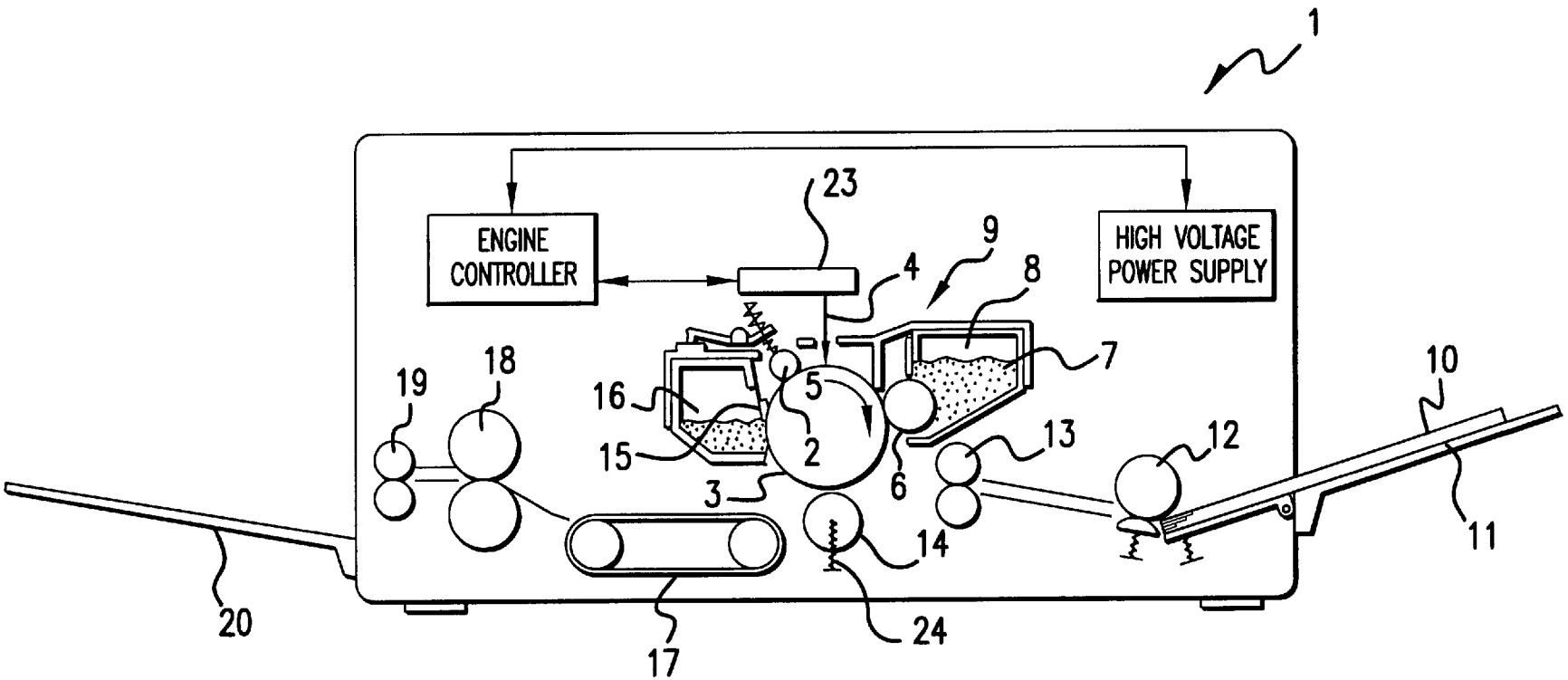
FIG. 1 shows a schematic cross section of a typical electrophotographic printer.

Referring to FIG. 1, shown is a simplified schematic representation of the cross section of an electrophotographic printer 1. Charge roller 2 is used to charge the surface of photoconductor drum 3 to a predetermined voltage. A laser diode in a laser scanner 23 emits a laser beam 4 which is pulsed on and off as it is swept across the surface of photoconductor drum 3 by the laser scanner to selectively discharge the surface of the photoconductor drum 3. Photoconductor drum 3 rotates in the clockwise direction as shown by the arrow 5. Developer 6 is used to develop the latent electrostatic image residing on the surface of photoconductor drum 3 after the surface voltage of the photoconductor drum 3 has been selectively discharged. Toner 7 which is stored in the toner hopper 8 of electrophotographic print cartridge 9 moves from locations within the toner hopper 8 to the developer 6. A magnet (not shown) located within the developer 6 magnetically attracts the toner to the surface of the developer 6. As the developer 6 rotates in the counterclockwise direction, the toner on the surface of the developer 6, located opposite the areas on the surface of photoconductor drum 3 which are discharged, is moved by the application of a potential to the developer 6 across the gap between the surface of the photoconductor drum 3 and the surface of the developer 6 to develop the latent electrostatic image.

Print media 10 is loaded from paper tray 11 by pickup roller 12 into the paper path of the electrophotographic printer 1. Print media 10 moves through the drive rollers 13 so that the arrival of the leading edge of print media 10 below photoconductor drum 3 is synchronized with the rotation of the region on the surface of photoconductor drum 3 having a latent electrostatic image corresponding to the leading edge of print media 10. As the photoconductor drum 3 continues to rotate in the clockwise direction, the surface of the photoconductor drum 3, having toner adhered to it in the discharged areas, contacts the print media 10 which has been charged by transfer roller 14 so that it attracts the toner particles away from the surface of the photoconductor drum 3 and onto the surface of the print media 10. The transfer of toner particles from the surface of photoconductor drum 3 to the surface of the print media 10 does not occur with one hundred percent efficiency and therefore some toner particles remain on the surface of photoconductor drum 3. As photoconductor drum 3 continues to rotate, toner particles which remain adhered to its surface are removed by cleaning blade 15 and deposited in toner waste hopper 16.

As the print media 10 moves in the paper path past photoconductor drum 3, conveyer belt 17 delivers the print media 10 to the fuser assembly 18. In the fuser assembly 18, heat is applied so that the toner particles are fused to the print media 10. Output rollers 19 push the print media 10 into the output tray 20 after it exits the fuser assembly 18. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

A high voltage power supply 21 supplies the bias voltages and bias currents to the charge roller 2, transfer roller 14, and developer 6 necessary for operation of the electrophotographic processes. The charge roller 2 is driven with a sinusoidal voltage waveform having a negative D.C. offset. The amplitude and frequency of the sinusoid are selected so that the surface of photoconductor drum 3 on which charge will be deposited is uniformly charged at approximately the value of the D.C. offset. The transfer roller 14 is driven with positive DC voltage during the transfer operation. The developer 6 is driven with a sinusoid voltage waveform having a variable negative D.C. offset.

Engine controller 22 generates the timing and control signals necessary to control the components in electrophotographic printer 1 to perform the electrophotographic printing process. These timing and control signals include signals which control the amplitude and timing of the voltages supplied by high voltage power supply 21 and the movement of the various rollers in the paper path. In addition, engine controller 22 provides the serial stream of binary print data to the laser scanner 23 for controlling the pulsing of laser beam 4.

Figure 2A:
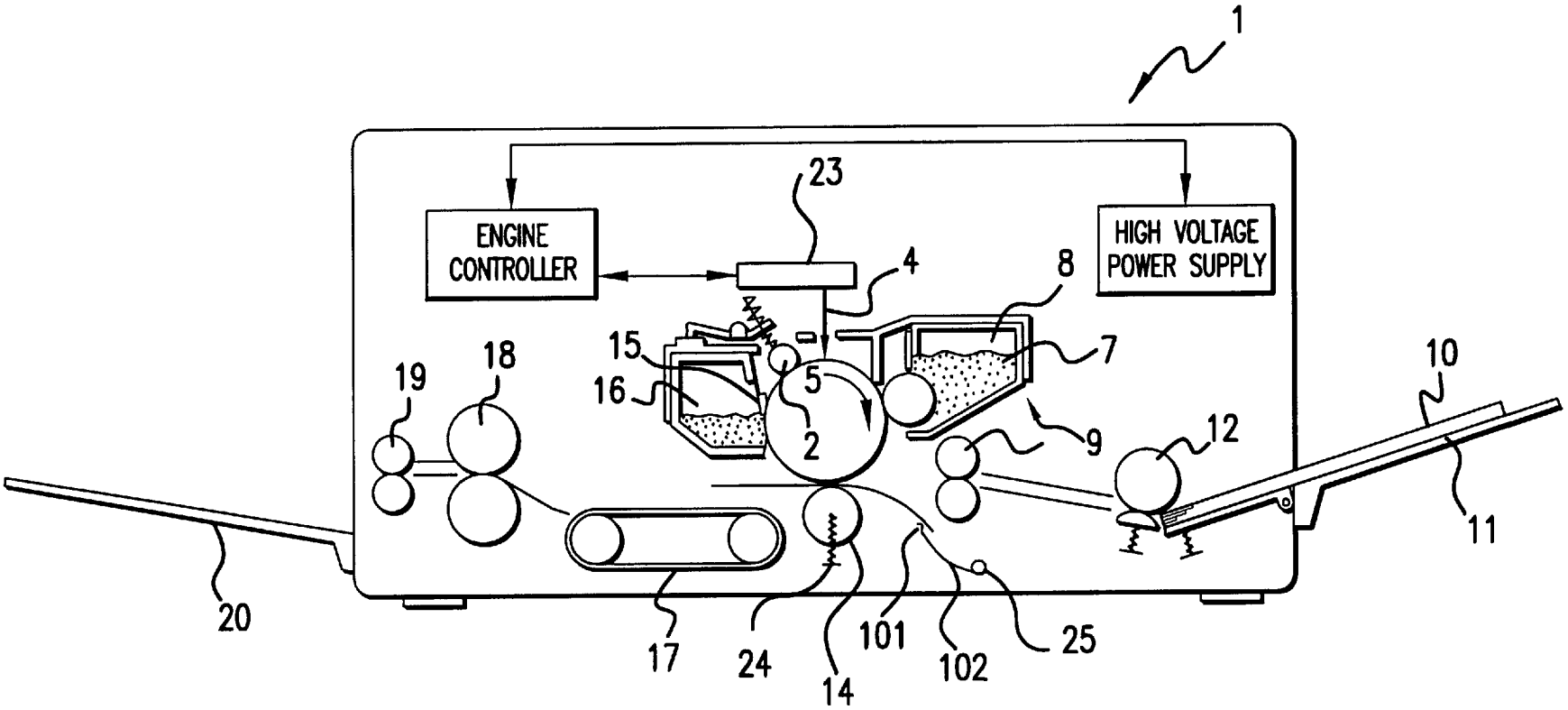
FIG. 2*a* shows a schematic cross section of a typical electrophotographic printer including a first embodiment of an electrophotographic component cleaning apparatus.

As the result of printing on a number of units of print media 10 using electrophotographic printer 1, contaminants accumulate on the surface of photoconductor drum 3. As previously mentioned, these contaminants can include fibers from the print media 10, fillers used in print media 10, and constituents of the toner 7. Accumulation of these contaminants prevents the proper operation of the electrophotographic process. Shown in FIG. 2*a* is a first embodiment of the electrophotographic component cleaning apparatus implemented in electrophotographic printer 1. Cleaning media 100 is inserted into the print media path of electrophotographic printer 1. Cleaning media 100 is retained in the print media path of electrophotographic printer 1 using a plastic strap 102 attached between the cleaning media 100 and a support bar 25 on the chassis of electrophotographic printer 1. It should be recognized that other retaining devices such as cord with a hook may be used to retain cleaning media 100 in the print media path. The retaining devices prevent cleaning media 100 from moving through the print media path as the rotation of photoconductor drum 3 attempts to pull cleaning media 100 through the print media path. As photoconductor drum 3 rotates in contact with cleaning media 100, contaminants on the surface of photoconductor drum are transferred to the surface of cleaning media 100. The cleaning operation may be initiated using the control panel of electrophotographic printer 1 or under the control of the host computer connected to electrophotographic printer 1. During the cleaning operation, engine controller 22 sets the outputs of the high voltage power supply 21 to zero and turns on the motor used to drive the gear train that rotates photoconductor drum 5. For enhanced removal of contaminants from the surface of photoconductor drum 3, a cleaning solution may be applied to cleaning media 100.

The material used for cleaning media 100 will depend upon the characteristics of the contaminant that must be removed. Contaminants tightly adhered to the surface of the electrophotographic component requiring cleaning are removed by using abrasives in cleaning media 100. In other cases, contaminant removal is accomplished using less aggressive materials for cleaning media 100. Other materials may be selected for cleaning media 100 depending upon the contaminants which must be removed from the surface of the electrophotographic component.

Examples of abrasive materials suitable for use in cleaning media 100 include metal oxide powders, such as aluminum oxide or titanium oxide, impregnated in plastic fibers. The plastic fibers are fused or woven into a mat to form cleaning media 100. Use of the abrasive particles embedded within plastic fibers allows fine control over the degree of abrasion and allows consistency in the degree of abrasion as the cleaning media 100 wears. Less abrasive cleaning materials for use in cleaning media 100 include felt, cloth, or open cell foam.

If a cleaning solution is applied to cleaning media 100, the chemical composition of this cleaning solution must be carefully selected. The cleaning solution selected will depend upon the nature of the contaminants. Some cleaning solutions may work by dissolving the contaminant and then trapping it in solution. Alternatively, other cleaning solutions may be sufficiently polar to pull the contaminants away from the surface. Another way that a cleaning solution may work is to change the adhesion of the contaminant to the surface. Or, the cleaning solution may be an inert solution which changes the rheological properties of the interface between the photoconductor drum 3 and the cleaning media 100 or increases the drag forces on the contaminant particles. The cleaning solution must not damage or degrade the material used for photoconductor drum 3 or the electrophotographic component used with the cleaning solution.

Figure 2B:
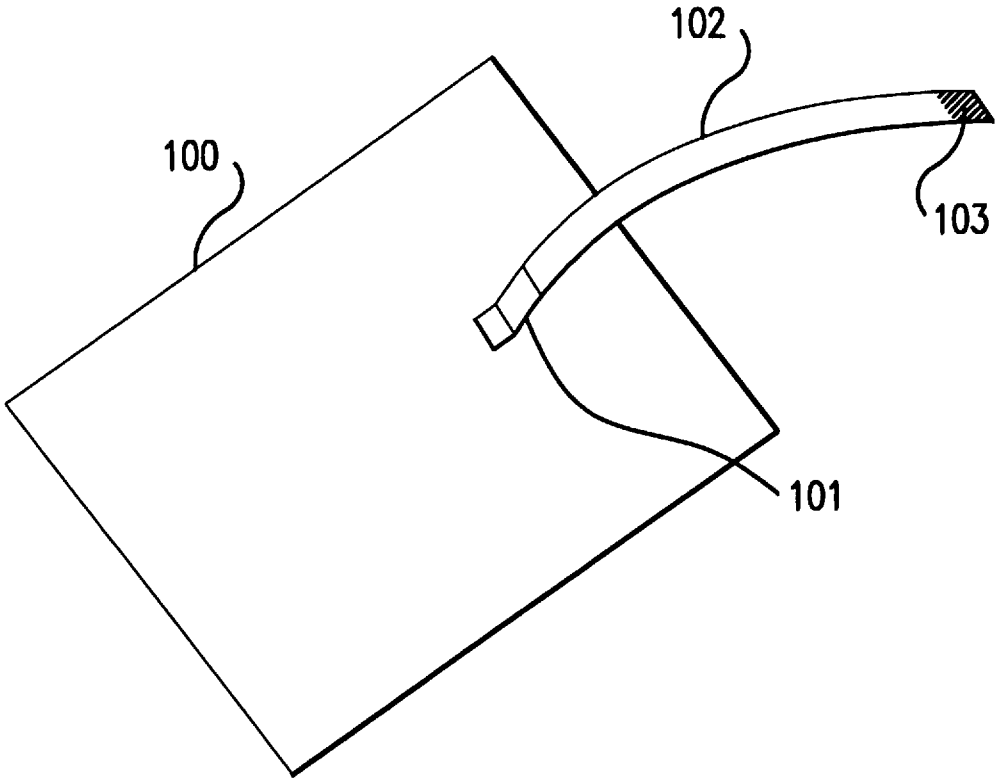
FIG. 2*b* is a perspective view showing details of the first embodiment of the electrophotographic component cleaning apparatus.

Shown in FIG. 2*b* is a diagram providing further detail of the retaining device used to hold cleaning media 100 in the print media path of electrophotographic printer 1 during the cleaning operation. In the preferred embodiment of the retaining device, a plastic tab 101 is molded or bonded onto cleaning media 100. A plastic strap 102 bonded to plastic tab 101 includes an area 103 having a re-useable adhesive. Plastic strap 102 is looped around any conveniently located protruding feature inside electrophotographic printer 1 (such as support bar 25) and attached to itself using the adhesive to hold cleaning media 100 in place.

Figure 2C:
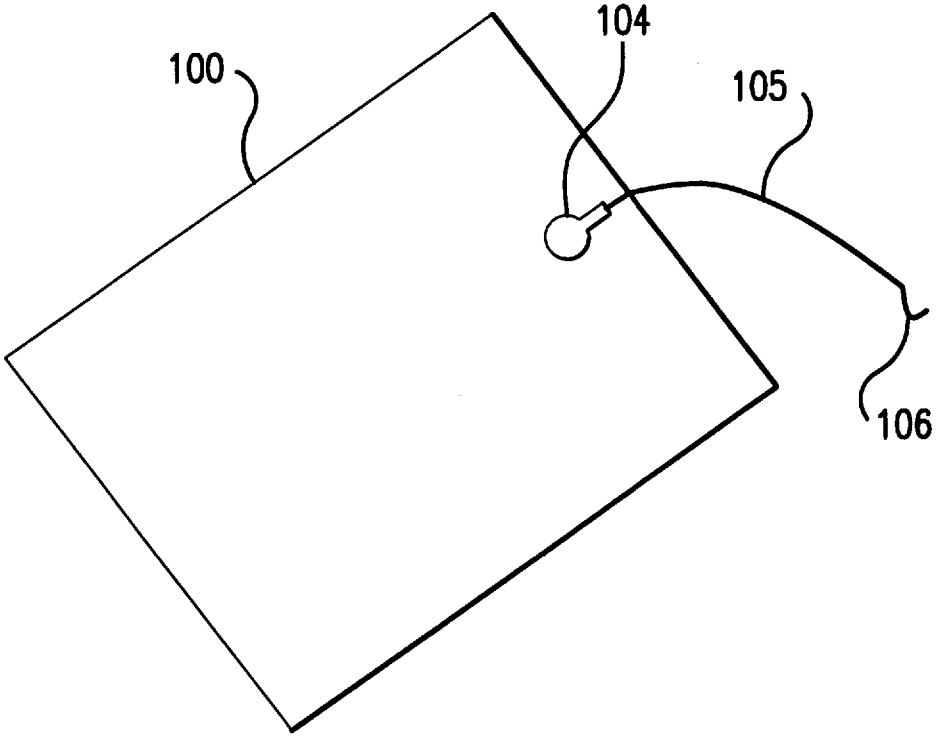
FIG. 2*c* is a perspective view showing details of an alternative of the first embodiment of the electrophotographic component cleaning apparatus.

An alternative implementation of a retaining device is shown in FIG. 2*c*. In this implementation, fastener 104 attached to cleaning media 100 provides an attachment point for a cord 105. A hook 106 fixed to one end of the cord 105 is engaged to any conveniently located protruding feature inside of electrophotographic printer 1. For both of the disclosed implementations of retaining devices it is preferable to locate the attachment point of the plastic strap 102 or the cord 105 on the centerline of the long dimension of cleaning media 100 and it is preferable to locate the attachment point of the plastic strap 102 or cord 105 to electrophotographic printer 1 at a location directly below the center line of the print media path. Restraining cleaning media 100 in this manner prevents rotation of cleaning media 100 in the print media path. Alternatively, two plastic straps or cords could be attached to the cleaning media 100, with one at each of the outside edges of the print media path.

Figure 3A:
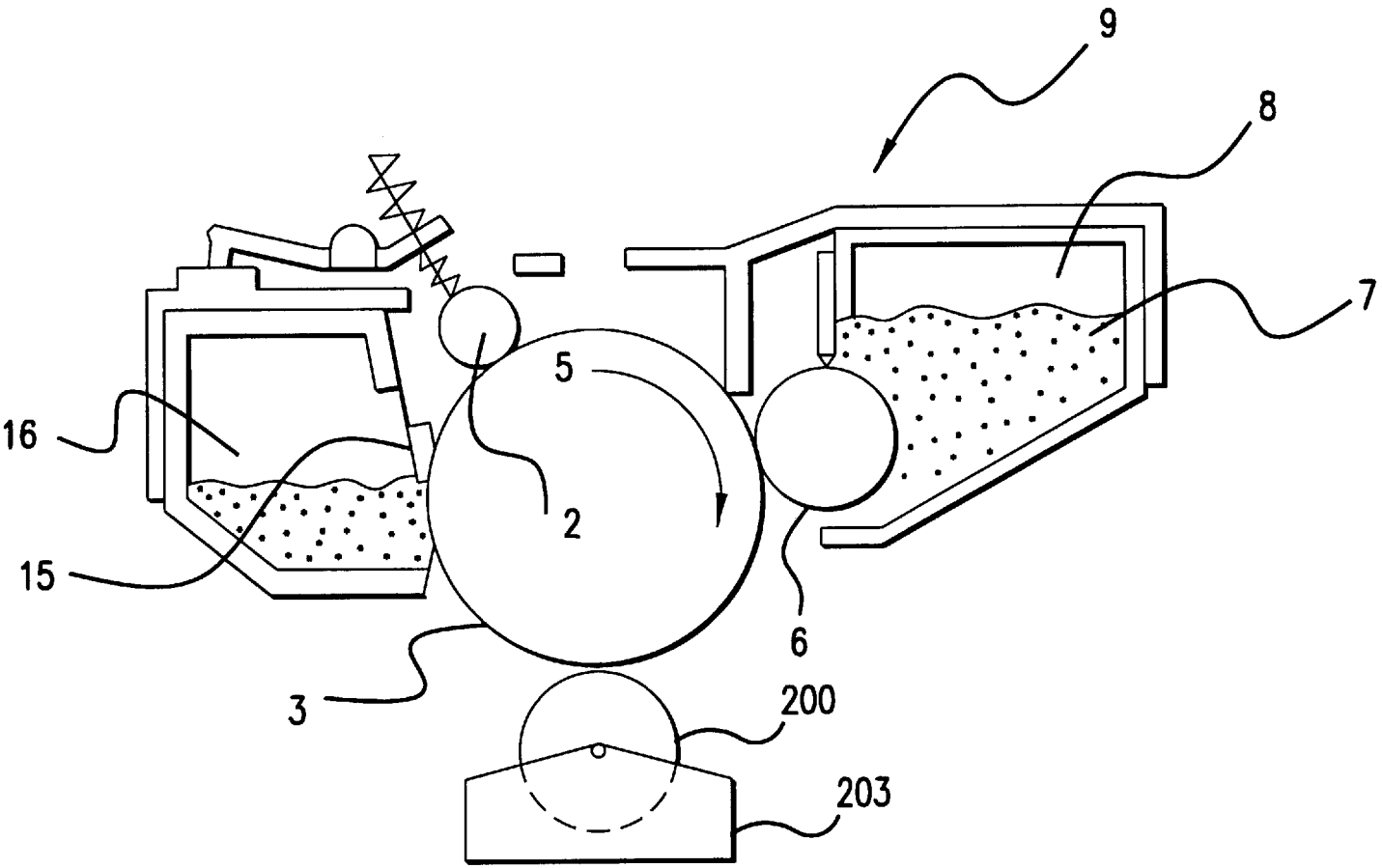
FIG. 3*a* is a schematic cross section showing an electrophotographic print cartridge and a second embodiment of the electrophotographic component cleaning apparatus.
Figure 3B:
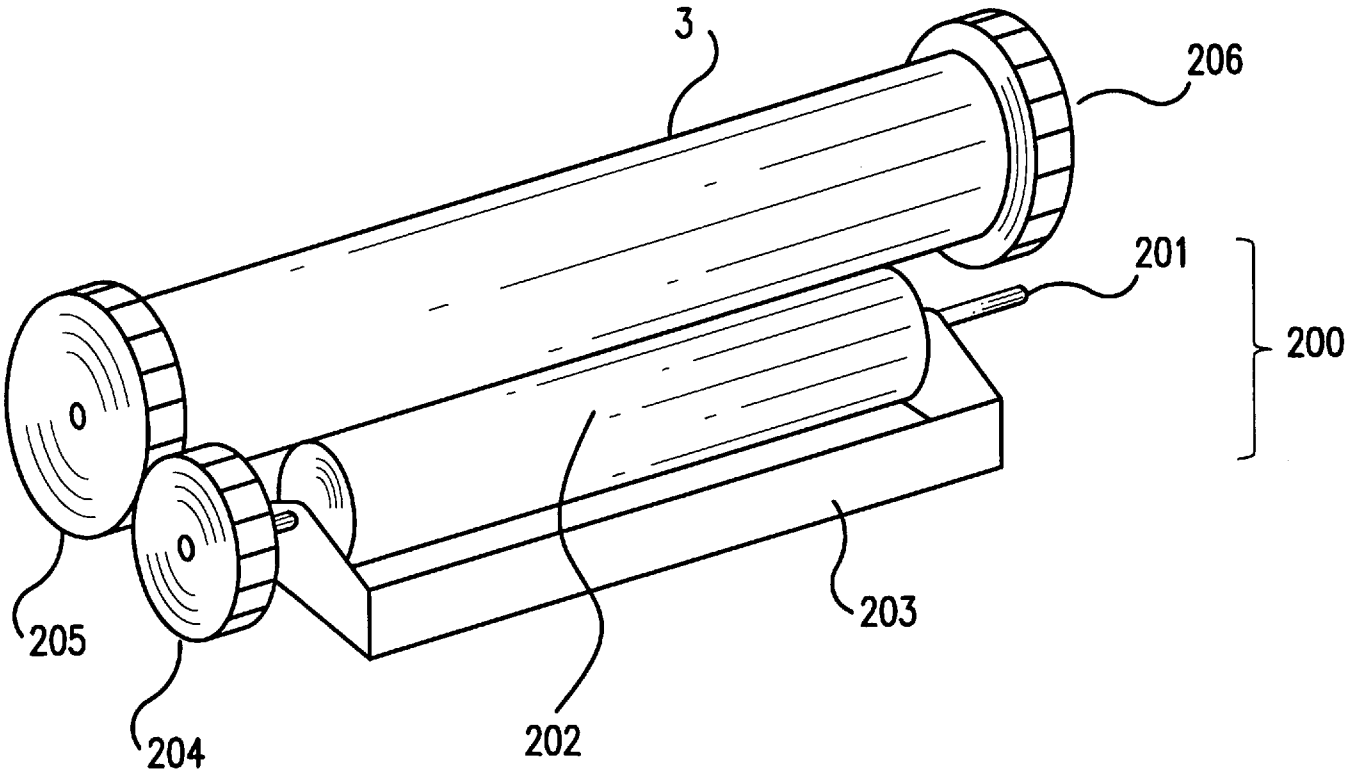
FIG. 3*b* shows a perspective view of the second embodiment of the electrophotographic component cleaning apparatus.

Shown in FIGS. 3*a* and 3*b* is a second embodiment of an electrophotographic component cleaning apparatus. Although the second embodiment of the electrophotographic component cleaning apparatus is used within electrophotographic printer 1, for the purpose of illustrative clarity, only the second embodiment of the electrophotographic component cleaning apparatus and the electrophotographic print cartridge 9 are shown in FIG. 3*a*. In the second embodiment of the electrophotographic component cleaning apparatus, a cleaning roller 200 replaces transfer roller 14 in electrophotographic printer 1. The cleaning roller 200 is designed so that it can be inserted into electrophotographic printer 1 after removal of transfer roller 14. As shown in FIG. 3*b*, the cleaning roller 200 includes a shaft 201 made of a rigid material, such as metal or plastic, surrounded by a cylinder 202 formed of a fluid absorbing material, such as an open cell foam, suitable for cleaning the surface of a photoconductor. A fluid reservoir 203 is pivotally mounted to the shaft 201 so that the fluid reservoir stays in position beneath cleaning roller 200 as it rotates during the cleaning operation. Fluid reservoir 203 is filled with a cleaning fluid to enhance the cleaning operation. Alternatively, cleaning roller 200 may be saturated with cleaning fluid prior to installation in electrophotographic printer 1. For this option the fluid reservoir 203 would not be included in the electrophotographic component cleaning apparatus.

As the cleaning roller 200 rotates, cleaning fluid absorbed into the cylinder 202 of porous material of cleaning roller 200 contacts the surface of photoconductor drum 3 and assists in the removal of contaminants. The cleaning roller 200 is of a larger diameter than transfer roller 14 so that it is compressed against the surface of photoconductor drum 3 to provide a scrubbing action that further assists in the removal of contaminants. The compressive force used to load the cleaning roller 200 is supplied by the springs 24 used to force transfer roller 14 against the surface of photoconductor drum 3 and by the top cover of electrophotographic printer 1 applying force to the electrophotographic print cartridge 9 housing photoconductor drum 3. When the cleaning operation is performed upon photoconductor drum 3, engine controller 22 sets the output voltages of high voltage power supply 21 to zero and turns the printer gear train drive motor on to rotate photoconductor drum 3.

In electrophotographic printer 1, the transfer roller 14 is gear driven by photoconductor drum 3. A first gear 204 attached on shaft 201 of cleaning roller 200 allows photoconductor drum 3 to drive cleaning roller 200. This first gear 204 meshes with a second gear 205 on photoconductor drum 3. Photoconductor drum gear 206 meshes with a gear in the gear train of electrophotographic printer 1. The second gear 205 on photoconductor drum 3 is driven by the photoconductor drum drive gear in the gear train of electrophotographic printer 1. In electrophotographic printer 1, the ratio of the gearing between transfer roller 14 and photoconductor drum 3 is selected so that the rotational velocities at the surface of transfer roller 14 and at the surface of photoconductor drum 3 are substantially equal. With the cleaning roller 200 of larger diameter than the transfer roller 14, and by designing first gear 204 to have the same gear ratio with second gear 205 as exists with transfer roller 14 in electrophotographic printer 1, the velocity at the surface of cleaning roller 200 is greater than at the surface of photoconductor drum 3. As a result, cleaning roller 200 is in sliding contact with photoconductor drum 3. This sliding contact enhances the cleaning action relative to the case in which the cleaning roller 200 rolls over the surface of photoconductor drum 3.

Figure 4A:
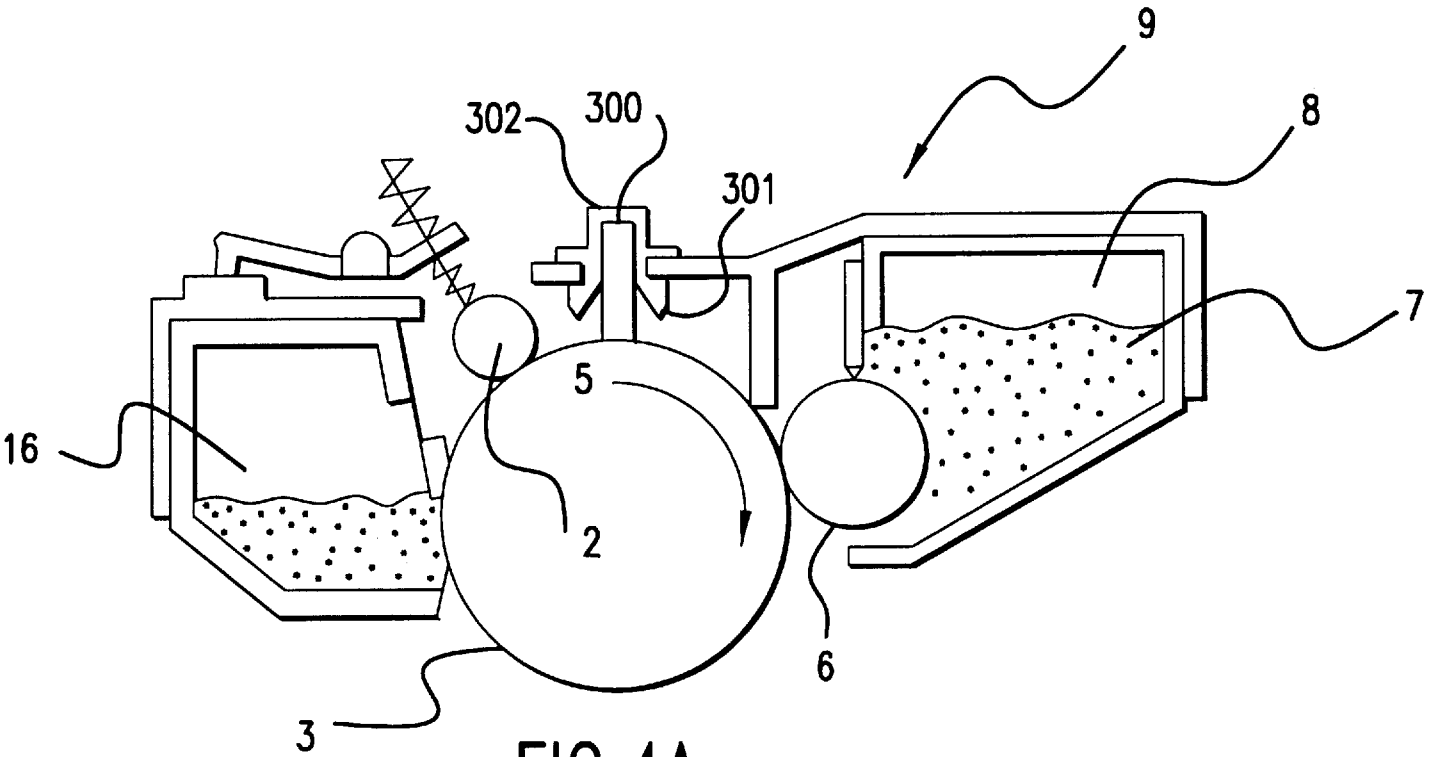
FIG. 4*a* is a schematic cross section of a fourth embodiment of the electrophotographic component cleaning apparatus.
Figure 4B:
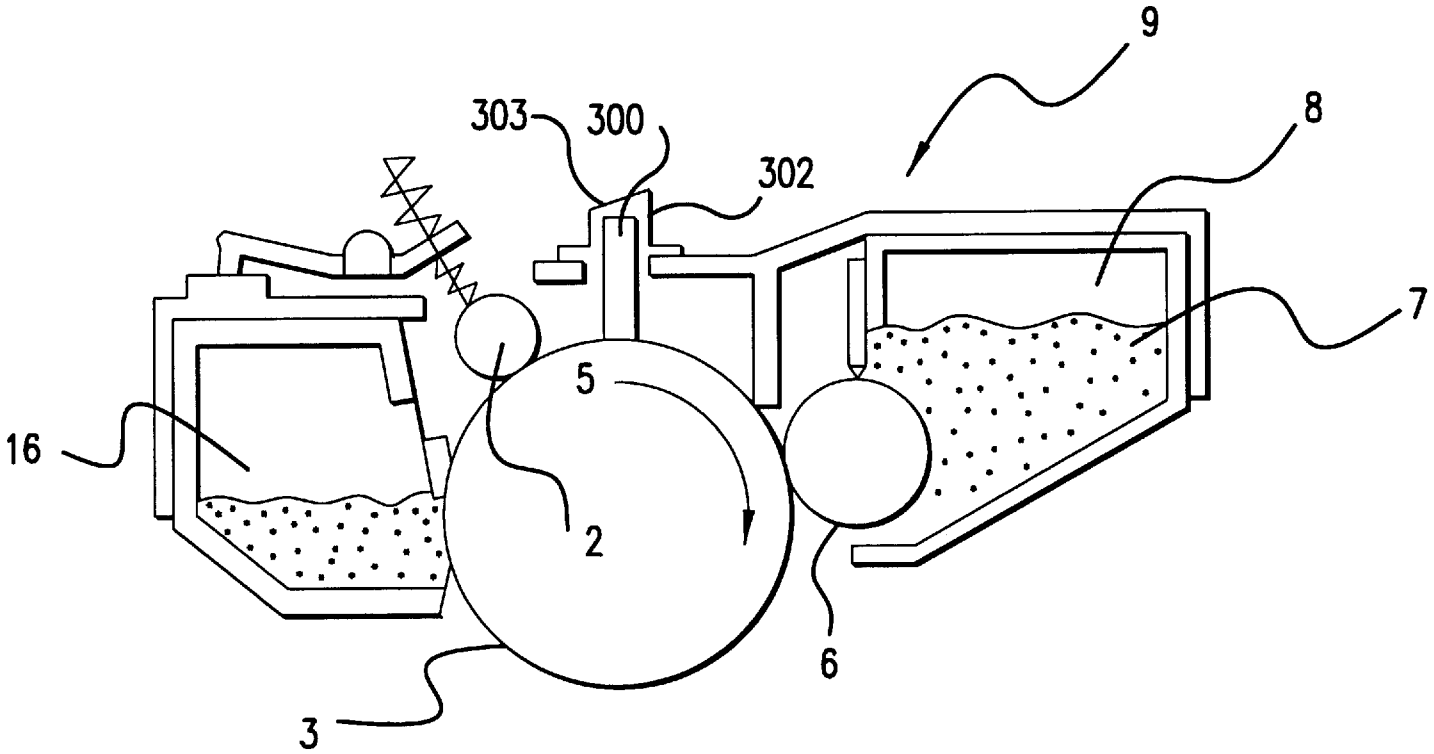
FIG. 4*b* is a schematic cross section of an alternative implementation of the fourth embodiment of the electrophotographic component cleaning apparatus.

Shown in FIG. 4*a* and FIG. 4*b* is a third embodiment of an electrophotographic component cleaning apparatus. In the third embodiment of the electrophotographic component cleaning apparatus, a cleaning pad 300 is inserted through the slot in the electrophotographic print cartridge 9 through which the laser beam passes. The material used for the cleaning pad 300 is selected using considerations similar to those used to select the material for the second embodiment of the electrophotographic cleaning apparatus. There are several alternatives available to load the cleaning pad 300 against the surface of photoconductor drum 3 for cleaning. The first alternative, shown in FIG. 4*a*, uses hooked flanges 301 on cleaning pad holder 302 which lock the cleaning pad 300 in place so that the cleaning pad is compressed against the surface of photoconductor drum 3. The cleaning pad is released from contact with the surface of photoconductor drum 3 by flexing the sides of cleaning pad holder 302 inward. The second alternative, shown in FIG. 4*b*, uses a sloped surface 303 on the cleaning pad holder 302 which is forced against the top cover of electrophotographic printer 1. The interference between the top cover and the cleaning pad holder 302 compresses the cleaning pad 300 against the surface of photoconductor drum 3. Cleaning pad 300 may be soaked in cleaning fluid prior to installation into electrophotographic print cartridge 9.

Figure 5:
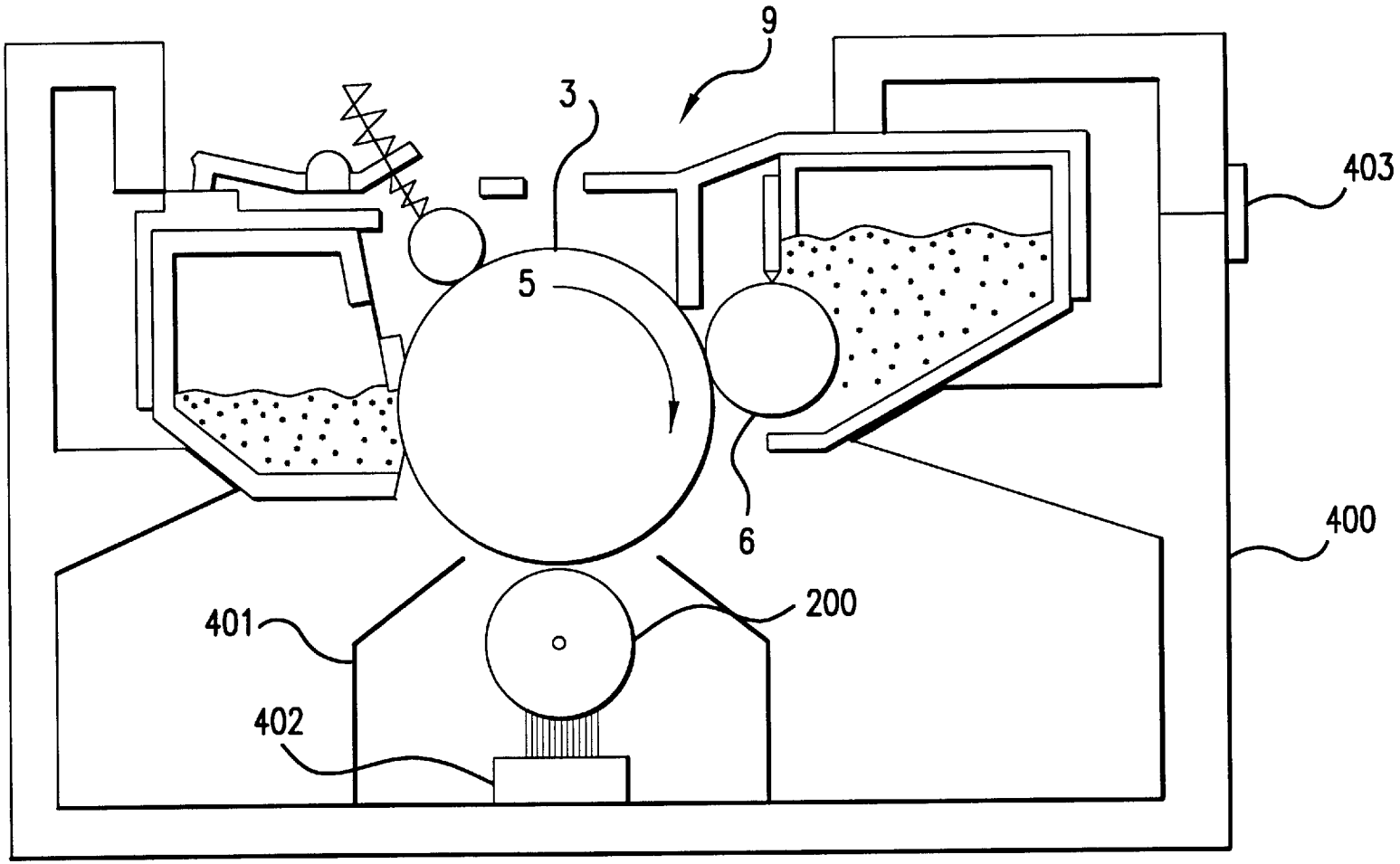
FIG. 5 shows a schematic cross section of a fifth embodiment of the electrophotographic component cleaning apparatus.

Shown in FIG. 5 is a fourth embodiment of an electrophotographic component cleaning apparatus. In the fourth embodiment, a stand 400 is used to mount the electrophotographic print cartridge for cleaning. The stand 400 serves to hold the electrophotographic print cartridge substantially stationary as cleaning roller 200 slides over the surface of photoconductor drum 3. The term "substantially stationary" in this context means that although the cartridge may undergo some movement during cleaning, there is no significant displacement of the cartridge. The stand 400 is hinged at 403 to allow insertion of electrophotographic print cartridge 9 into the stand 400 for cleaning. Included in stand 400 is a motor and a gear train (not shown) used to drive the photoconductor drum 3 and the cleaning roller 200. Alternatively, the gear train may be driven manually using a hand crank. The stand 400 serves as a substitute for the chassis of electrophotographic printer 1 to hold electrophotographic print cartridge substantially stationary while rotating photoconductor drum 3 and cleaning roller 200. Although some displacement of the cartridge is allowed as the gear train drives photoconductor drum 3, the displacement must be sufficiently small so that cleaning roller 200 maintains contact with the surface of photoconductor drum 3. A fluid reservoir 401 is used to hold a cleaning fluid. As was the case for the previous embodiments of the electrophotographic component cleaning apparatus, cleaning roller 200 maybe constructed from a fluid absorbing material such as felt or sponge. The cleaning fluid absorbed into the cleaning roller 200 cleans the surface of photoconductor drum 3 as it rotates. A cleaning brush 402 removes contaminants accumulated on the surface of cleaning roller 200 to improve the cleaning efficiency. With the cleaning brush 402, each rotation of cleaning roller 200 presents a clean surface to photoconductor drum 3.

Similar to the second embodiment of the electrophotographic component cleaning apparatus, the cleaning roller 200 could be geared so that it is driven at a higher rotational rate than the photoconductor drum 3 to establish sliding contact with the surface of photoconductor drum 3. Alternatively, the stand 400 may be geared so that cleaning roller 200 rotates in the opposite direction of photoconductor drum 3. This arrangement would provide additional cleaning action.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. An apparatus for cleaning an electrophotographic component in an electrophotographic imaging device having a media path, said apparatus comprising:

a sheet of cleaning media for insertion into said media path and for contact with said electrophotographic component; and a retaining device coupled to said sheet of cleaning media, said retaining device for retaining said sheet of cleaning media in said media path during movement of said electrophotographic component.

2. The apparatus as recited in claim 1, wherein:

said retaining device includes a fastener attached to said sheet of cleaning media;

a cord attached to said fastener; and a hook attached to said cord.

3. The apparatus as recited in claim 1, wherein:

said retaining device includes a tab attached to said sheet of cleaning media; and a strap attached to said tab, said strap having an adhesive located on an end opposite the attachment to said tab.

4. The apparatus as recited in claim 3, wherein:

the materials forming said cleaning media include felt.

5. The apparatus as recited in claim 3, wherein:

the materials forming said cleaning media include cloth.

6. The apparatus as recited in claim 3, wherein:

the materials forming said cleaning media include plastic fibers containing an abrasive selected from the group consisting of aluminum oxide and titanium oxide.

7. In an electrophotographic imaging device, an apparatus for cleaning a photoconductor drum having a first gear, comprising:

a cleaning roller formed from a resilient material and having a longitudinal axis, said cleaning roller for compressing against said photoconductor drum;

a rigid shaft coincident with said longitudinal axis;

a second gear mounted on said rigid shaft for meshing with said first gear to rotate said cleaning roller; and a reservoir pivotally mounted on said rigid shaft, said reservoir having an interior region partially enclosing said cleaning roller.

8. The apparatus as recited in claim 7, wherein:

said electrophotographic imaging device includes a removable transfer roller; and said cleaning roller installs in said electrophotographic imaging device in substitution for said transfer roller.

9. The apparatus as recited in claim 7, wherein:

an electrophotographic print cartridge includes said photoconductor drum.

10. The apparatus as recited in claim 9, further comprising:

a stand having said reservoir mounted thereupon, said stand for holding said electrophotographic print cartridge substantially stationary during rotation of said cleaning roller.

11. The apparatus as recited in claim 10, further comprising:

a brush mounted in said interior region of said reservoir and contacting said cleaning roller.

12. The apparatus as recited in claim 11, wherein:

said cleaning roller rotates in a direction opposite to that of said photoconductor drum.

13. An apparatus for cleaning an electrophotographic component in an electrophotographic imaging device, comprising:

a member having a channel, said member for removably mounting on said electrophotographic imaging device; and a pad formed of a resilient material disposed in said channel and of sufficient size to contact said electrophotographic component with said member mounted on said electrophotographic imaging device.

14. The apparatus as recited in claim 13, wherein:

said electrophotographic component includes a photoconductor drum incorporated within an electrophotographic print cartridge having an access slot for a laser beam, said pad adapted for insertion into said access slot.

15. The apparatus as recited in claim 14, wherein:

said member includes a pair of hooked flanges protruding from said member adjacent to the sides of said channel for insertion into said access slot to removably mount said member to said electrophotographic print cartridge so that said pad compresses against said photoconductor drum.

16. The apparatus as recited in claim 15, wherein:

the materials forming said pad include felt.

17. The apparatus as recited in claim 16, wherein:

said member includes a sloped surface located opposite said channel.

* * * * *